US010568190B2

(12) United States Patent
Kurihara et al.

(10) Patent No.: US 10,568,190 B2
(45) Date of Patent: Feb. 18, 2020

(54) REMOTE CONTROL, LIGHTING SYSTEM, AND LUMINAIRE

(71) Applicant: PANASONIC INTELLECTUAL PROPERTY MANAGEMENT CO., LTD., Osaka (JP)

(72) Inventors: Shinichiro Kurihara, Osaka (JP); Tomoaki Mannami, Osaka (JP); Kouichi Mitsushima, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 16/366,974

(22) Filed: Mar. 27, 2019

(65) Prior Publication Data

US 2019/0223276 A1 Jul. 18, 2019

Related U.S. Application Data

(63) Continuation of application No. 15/894,165, filed on Feb. 12, 2018, now Pat. No. 10,349,499.

(30) Foreign Application Priority Data

Feb. 15, 2017 (JP) ..... 2017-026215

(51) Int. Cl.
*H05B 37/02* (2006.01)

(52) U.S. Cl.
CPC ..... *H05B 37/0272* (2013.01); *H05B 37/0227* (2013.01)

(58) Field of Classification Search
CPC ..... H05B 37/0272; H05B 37/0227
See application file for complete search history.

(56) References Cited

U.S. PATENT DOCUMENTS

2006/0049935 A1* 3/2006 Giannopoulos ..... H05B 37/02 340/533
2013/0065642 A1* 3/2013 Liu ..... G08C 17/02 455/557

(Continued)

FOREIGN PATENT DOCUMENTS

JP 2009-232234 A 10/2009
JP 2013-145634 A 7/2013

(Continued)

OTHER PUBLICATIONS

Non-Final Office Action issued in U.S. Appl. No. 15/894,165, dated Aug. 9, 2018.

(Continued)

*Primary Examiner* — Raymond R Chai
(74) *Attorney, Agent, or Firm* — McDermott Will & Emery LLP

(57) ABSTRACT

A remote control for controlling a luminaire is wirelessly controllable with a terminal device. The remote control includes: a receiver that receives an input from a user; a first communication circuit that communicates wirelessly; and a first controller that generates a control signal and transmits the control signal to the luminaire via the first communication circuit, in which the control signal corresponds to the input received by the receiver and includes identification information unique to the terminal device as a source address.

19 Claims, 6 Drawing Sheets

(56) References Cited

U.S. PATENT DOCUMENTS

| | | | | |
|---|---|---|---|---|
| 2013/0088846 | A1* | 4/2013 | Bonarirgo | H02J 9/02 362/20 |
| 2013/0181607 | A1 | 7/2013 | Yotsumoto et al. | |
| 2014/0015415 | A1* | 1/2014 | Lim | H05B 37/0272 315/131 |
| 2014/0175875 | A1* | 6/2014 | Newman, Jr. | H04L 69/18 307/18 |
| 2014/0265881 | A1* | 9/2014 | Karc | H05B 37/0272 315/158 |
| 2015/0382436 | A1* | 12/2015 | Kelly | G08C 17/02 315/131 |
| 2016/0226732 | A1* | 8/2016 | Kim | H04L 12/2807 |
| 2018/0092194 | A1* | 3/2018 | Bard | H04L 12/2816 |
| 2018/0116040 | A1* | 4/2018 | Mann | G05B 15/02 |
| 2019/0141824 | A1* | 5/2019 | De Jong | H04L 12/2816 |

FOREIGN PATENT DOCUMENTS

| | | | |
|---|---|---|---|
| WO | 2014/106786 | A1 | 7/2014 |
| WO | 2017/140565 | A1 | 8/2017 |

OTHER PUBLICATIONS

Final Office Action issued in U.S. Appl. No. 15/894,165, dated Dec. 28, 2018.

Notice of Allowance issued in related U.S. Appl. No. 15/894,165, dated Apr. 3, 2019.

* cited by examiner

REMOTE CONTROL, LIGHTING SYSTEM, AND LUMINAIRE

CROSS REFERENCE TO RELATED APPLICATION

This application is a continuation of U.S. patent application Ser. No. 15/894,165 filed Feb. 12, 2018, which claims the benefit of priority of Japanese Patent Application Number 2017-026215 filed on Feb. 15, 2017, the entire content of which is hereby incorporated by reference.

BACKGROUND

1. Technical Field

The present disclosure relates to a remote control, a lighting system including the remote control, and a luminaire.

2. Description of the Related Art

Conventionally, luminaires with a wireless communication function are known. The luminaires with wireless communication functionality each include an antenna for wireless communication and perform processing according to a control signal which is a wireless signal received by the antenna (see, for example, Japanese Unexamined Patent Application Publication No. 2013-145634).

SUMMARY

In the meanwhile, some of the luminaires are wirelessly controlled by terminal devices such as a smartphone and a tablet. A user can change such a luminaire to a desired lighting state by operating a remote control or a terminal device.

However, in a conventional lighting system, when a luminaire is controlled by a remote control, a control signal is transmitted only to the luminaire. Accordingly, the current lighting state of the luminaire may not be the same as the lighting state of the luminaire in an application of the terminal device when the terminal device is turned on. Moreover, when the luminaire is turned on by a wall switch, the control signal is also not transmitted to the terminal device. Accordingly, the current lighting state of the luminaire may not be the same as the lighting state of the luminaire in an application of the terminal device when the terminal device is turned on. Therefore, when the terminal device is used to change the lighting state of the luminaire, the user is required to start with obtaining information on the current lighting state from the luminaire by operating the terminal device.

In view of the foregoing, an object of the present disclosure is to provide a remote control with improved convenience, a lighting system including the remote control, and a luminaire.

In order to achieve the object, a remote control according to an aspect of the present disclosure is a remote control for controlling a luminaire that is wirelessly controllable with a terminal device, and includes: a receiver that receives an input from a user; a first communication circuit that communicates wirelessly; and a first controller that generates a control signal and transmits the control signal to the luminaire via the first communication circuit, in which the control signal corresponds to the input received by the receiver and includes identification information unique to the terminal device as a source address.

In order to achieve the object, a lighting system according to an aspect of the present disclosure includes the above-mentioned remote control; a luminaire that is controlled by the remote control; and a terminal device that wirelessly controls the luminaire, in which the luminaire includes a second communication circuit that transmits, upon receiving the control signal from the remote control, a signal indicating receipt of the control signal to the terminal device identified by the source address.

In order to achieve the object, a luminaire according to an aspect of the present disclosure is wirelessly controllable with a terminal device, and includes: a light source; an energization sensor that senses receipt of power from a commercial power supply; and a second communication circuit that transmits a signal indicating the receipt of power to the terminal device when the energization sensor senses the receipt of power.

With the remote control, the lighting system including the remote control, and the luminaire according to an aspect of the present disclosure, it is possible to improve the convenience.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENTS

Hereinafter, exemplary embodiments of the present disclosure will be described in detail with reference to the drawings. It should be noted that each of the embodiments described below shows a specific example of the present disclosure. The numerical values, shapes, materials, structural components, the arrangement and connection of the structural components, steps, the sequence of the steps, etc. shown in the following exemplary embodiments are mere examples, and therefore do not intend to limit the present disclosure. Therefore, among elements in the following embodiment, those not recited in any of the independent claims defining the broadest inventive concept are described as optional elements.

It should be noted that the figures are schematic drawings, and are not necessarily exact depictions. In the figures, elements having essentially the same configuration share like reference numbers. Accordingly, overlapping descriptions thereof are omitted or simplified.

Embodiment 1

The lighting system according to Embodiment 1 will be described with reference to FIG. 1 to FIG. 4. In Embodiment 1, a remote control is used to control luminaires installed inside a building.

[1. Configuration of Lighting System]

Figure 1:
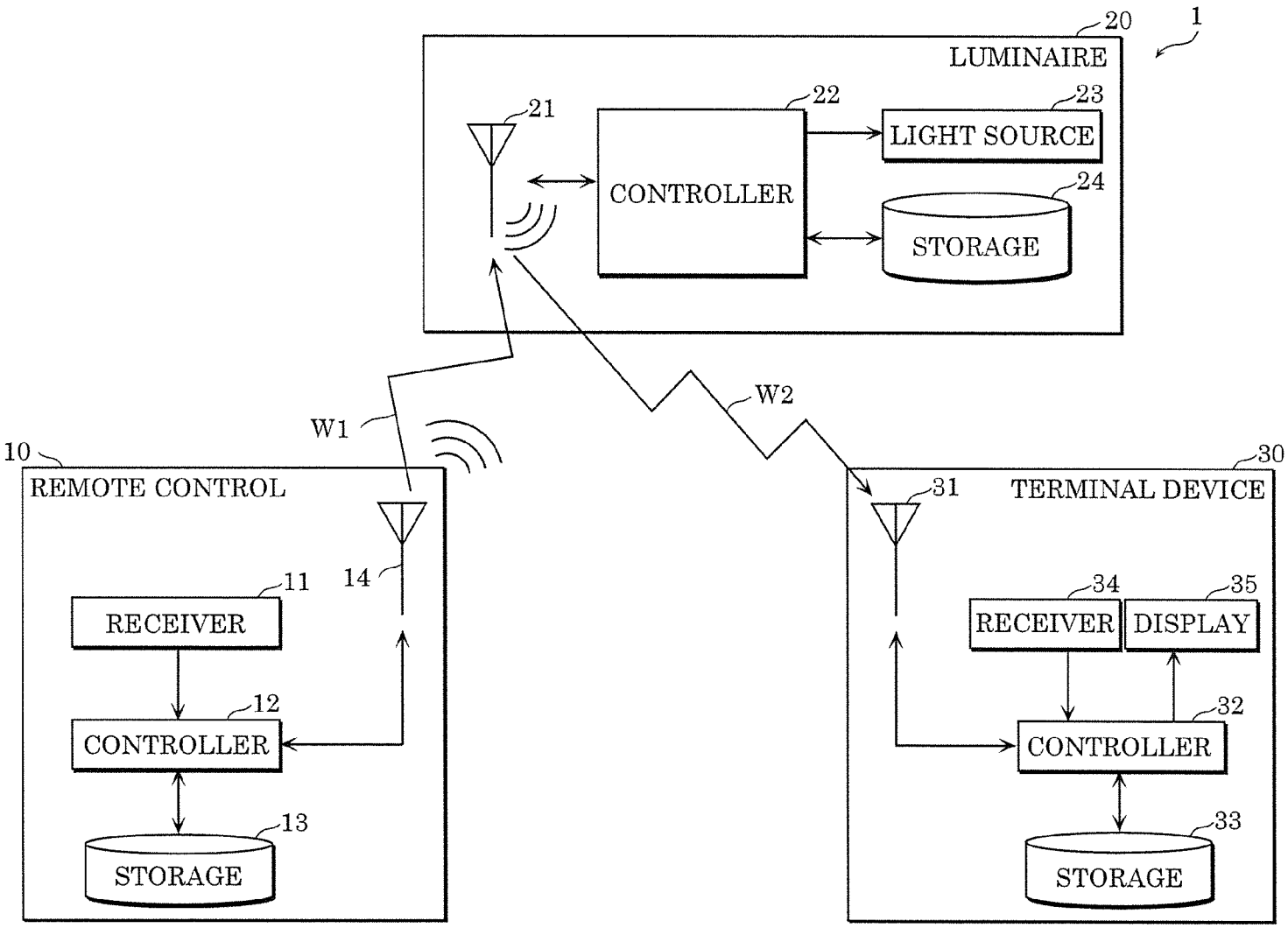
FIG. 1 is a block diagram illustrating an entire configuration of a lighting system according to Embodiment 1.

First of all, lighting system 1 according to the present embodiment will be described with reference to FIG. 1. FIG. 1 is a block diagram illustrating an entire configuration of lighting system 1 according to the present embodiment.

Lighting system 1 according to the present embodiment includes remote control 10, luminaire 20, and terminal device 30. Remote control 10, luminaire 20, and terminal device 30 each have wireless communication functionality, and luminaire 20 changes the lighting state based on a control signal transmitted from remote control 10 or terminal device 30. It should be noted that in FIG. 1 there is a single luminaire, but the number of luminaires included in lighting system 1 is not limited to one. There may be two or more luminaires. Moreover, the wireless communication refers to, for example, a wireless communication using the Bluetooth (registered trademark) communication standard, but is not limited to this communication standard. Wireless LANs (e.g., Wi-Fi (registered trademark)) may be used.

[1-1. Remote Control]

First, remote control 10 will be described. Remote control 10 is a dedicated control terminal for controlling luminaire 20 included in lighting system 1. As illustrated in FIG. 1, remote control 10 includes receiver 11, controller 12, storage 13, and communication circuit 14.

Figure 4:
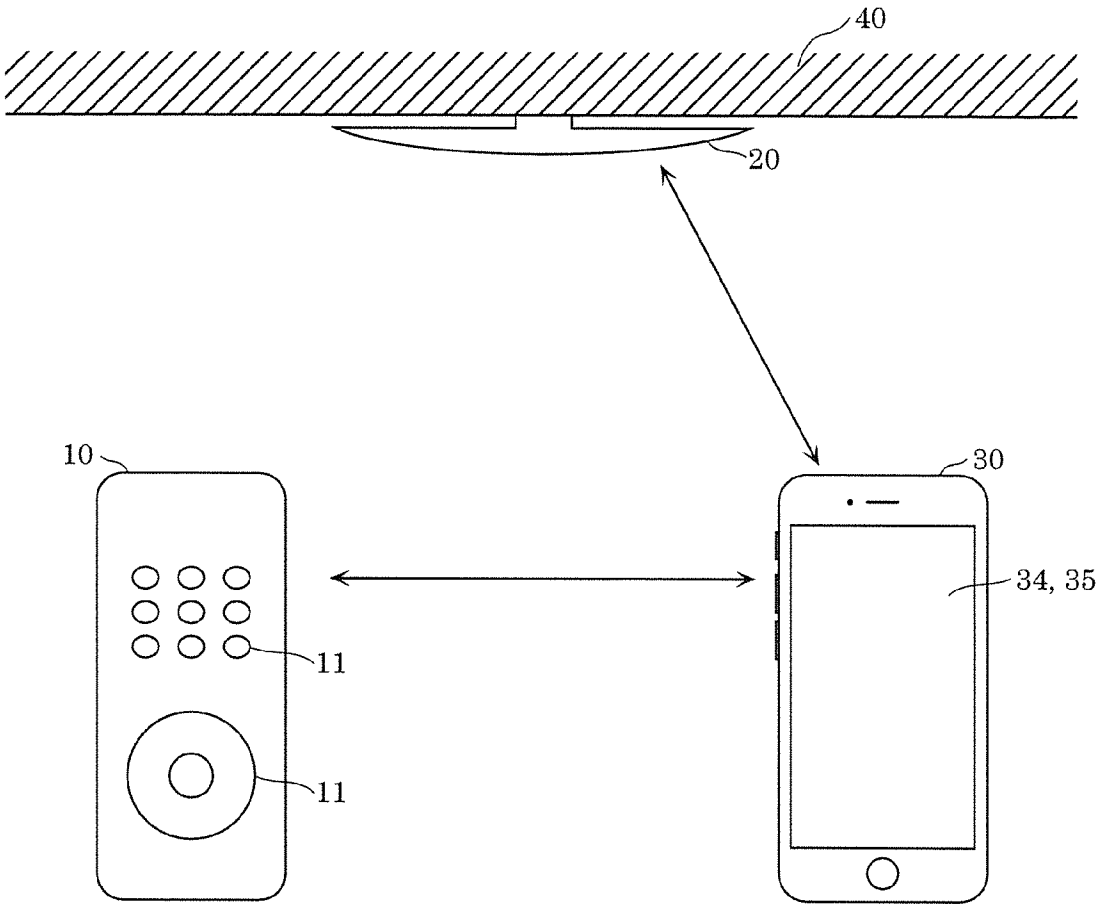
FIG. 4 is a schematic diagram illustrating the association of a lighting system according to Embodiment 1.

Receiver 11 is a user interface for receiving an input from a user to change the lighting state of luminaire 20, and is implemented as, for example, push buttons (see FIG. 4). For example, receiver 11 includes push buttons each corresponding to a different lighting state of luminaire 20. By pressing a push button corresponding to the intended lighting state for the user, a control signal corresponding to the push button is transmitted to luminaire 20 from remote control 10.

It should be noted that receiver 11 is not limited to the push buttons. For example, a touch panel is possible as long as an input is received from the user. In this case, remote control 10 may include a display for displaying the lighting state or the like.

Here, the lighting state includes lighting on, lighting off, blinking, dimming, and color tuning.

Controller 12 is a control device for controlling each of the components included in remote control 10 according to the input received by receiver 11. For example, controller 12 receives the input received by receiver 11 (e.g., a change to the intended lighting state for the user), generates a control signal corresponding to the received input, and transmits the generated control signal (W1 in FIG. 1) to luminaire 20 via communication circuit 14. Control signal W1 includes a source address. Controller 12 generates control signal W1 including, as the source address, not identification information unique to remote control 10 (e.g., a device ID) but identification information unique to terminal device 30 (e.g., a device ID). Remote control 10 according to the present embodiment is characterized in that the identification information of terminal device 30 is used as the source address included in the control signal. It should be noted that the identification information unique to terminal device 30 is, for example, pre-stored on storage 13, and controller 12 retrieves the identification information of terminal device 30 from storage 13.

Controller 12 is implemented as a processor that executes a control program stored on storage 13, but not limited to a processor. Controller 12 may be implemented as a microcomputer, a dedicated circuit, or the like. It should be noted that controller 12 is an example of the first controller.

Storage 13 is a storage device for storing a control program to be executed by controller 12. Storage 13 also stores the identification information of luminaire 20 and the identification information of terminal device 30. For example, storage 13 is implemented as a flash memory, a semiconductor memory, or the like.

Communication circuit 14 is a wireless communication interface for remote control 10 to wirelessly communicate with luminaire 20. Communication circuit 14 establishes a wireless communication connection with a target device (e.g., luminaire 20), and then wirelessly communicates with the target device. In the present embodiment, communication circuit 14 establishes a wireless communication connection with luminaire 20. Moreover, in the present embodiment, the wireless communication is performed using the Bluetooth (registered trademark) communication standard, and thus communication circuit 14 is a communication module (e.g., a communication circuit) supporting the Bluetooth (registered trademark) communication standard. It should be noted that communication circuit 14 is an example of the first communication circuit.

[1-2. Luminaire]

Next, luminaire 20 will be described. Luminaire 20 is, for example, a lighting apparatus for indoor use which is installed inside a building and illuminates the indoor space. Luminaire 20 is powered and lighted by electrical power to illuminate a space in which luminaire 20 is installed. Luminaire 20 is, for example, a ceiling light, a spot light, or a pendant light. Lighting system 1 may include two or more luminaires which may be the same or different types of luminaires. It should be noted that the lighting state of luminaire 20 is wirelessly controlled by remote control 10 or terminal device 30.

As illustrated in FIG. 1, luminaire 20 includes communication circuit 21, controller 22, light source 23, and storage 24. It should be noted that in FIG. 1, a commercial power supply and a power supply circuit included in luminaire 20 (e.g., a circuit for converting alternating-current power into direct-current power) are omitted.

Communication circuit 21 is a wireless communication interface for luminaire 20 to wirelessly communicate with remote control 10 and terminal device 30. Communication circuit 21 establishes wireless communication connections with target devices (e.g., remote control 10 and terminal device 30), and then wirelessly communicates with the target devices. In the present embodiment, communication circuit 21 establishes wireless communication connections with remote control 10 and terminal device 30. Moreover, in the present embodiment, the wireless communications are performed using the Bluetooth (registered trademark) communication standard, and thus communication circuit 21 is a communication module (e.g., a communication circuit) supporting the Bluetooth (registered trademark) communication standard. It should be noted that communication circuit 21 is an example of the second communication circuit.

Controller 22 is a control device for controlling each of the components included in luminaire 20. For example, controller 22 receives control signal W1 transmitted from remote control 10 via communication circuit 21, and controls the lighting state of light source 23 based on the received control signal W1. Moreover, controller 22 transmits a signal indicating receipt of control signal W1 (hereinafter referred to as response signal W2) to the source address in control signal W1 received from remote control 10. In the present embodiment, controller 22 transmits response signal W2 to terminal device 30 since controller 22 receives control signal W1 including the identification information of terminal device 30 as the source address. It should be noted that the details of control signal W1 and response signal W2 will be described later.

Controller 22 is implemented as a processor that executes a control program stored on storage 24, but not limited to a processor. Controller 22 may be implemented as a microcomputer, a dedicated circuit, or the like. It should be noted that if controller 22 supports dimming functionality, controller 22 includes a dimming control circuit (e.g., a pulse width modulation (PWM) circuit). In other words, an aspect of controller 22 is not particularly limited. It should be noted that controller 22 is an example of the second controller.

Light source 23 is a light source that emits illumination light. Light source 23 is implemented as a LED, but may be implemented as an incandescent lamp or a fluorescent lamp. Alternatively, light source 23 also may be implemented as a semiconductor laser, an organic EL element, an inorganic EL element, etc.

Storage 24 is a storage device for storing a control program to be executed by controller 22. Moreover, storage 24 also stores the identification information of remote control 10 and the identification information of terminal device 30. For example, storage 24 is implemented as a flash memory, a semiconductor memory, or the like.

It should be noted that lighting system 1 may include two or more luminaires including luminaire 20, and the two or more luminaires may communicate with each other using multi-hop communication. More specifically, upon receiving control signal W1 from remote control 10 via communication circuit 21, luminaire 20 transmits, via communication circuit 21, control signal W1 to another luminaire that fails to receive control signal W1 from remote control 10 (not shown). For example, storage 24 may store routing information for transmitting a control signal, and controller 22 may transmit the control signal to another luminaire based on the routing information. In this case, the identification information of terminal device 30 is used as the source address in the control signal transmitted by luminaire 20. In other words, in multi-hop communication, all of the luminaires receive the control signal including the identification information of terminal device 30 as the source address.

[1-3. Terminal Device]

Next, terminal device 30 will be described. Terminal device 30 is a control terminal for wirelessly controlling the lighting state of luminaire 20. In the present embodiment, terminal device 30 wirelessly and directly communicates with luminaire 20.

Terminal device 30 is implemented as, for example, a smartphone, a mobile phone terminal, a tablet terminal, or a personal computer. It should be noted that terminal device 30 according to the present embodiment is a smartphone. In this case, the smartphone can control a luminaire after downloading a dedicated application and setting up the initial configuration of operations with respect to the luminaire.

As illustrated in FIG. 1, terminal device 30 includes communication circuit 31, controller 32, storage 33, receiver 34, and display 35.

Communication circuit 31 is a wireless communication interface for terminal device 30 to wirelessly communicate with luminaire 20. Communication circuit 31 establishes a wireless communication connection with a target device (e.g., luminaire 20), and then wirelessly communicates with the target device. In the present embodiment, communication circuit 31 establishes a wireless communication connection with luminaire 20. Moreover, in the present embodiment, the wireless communications are performed using the Bluetooth (registered trademark) communication standard, and thus communication circuit 31 is a communication module (e.g., a communication circuit) supporting the Bluetooth (registered trademark) communication standard.

Controller 32 is a control device for controlling each of the components included in terminal device 30. For example, controller 32 receives response signal W2 transmitted from luminaire 20 via communication circuit 31, and updates the lighting state of luminaire 20 stored on terminal device 30, based on the received response signal W2. Moreover, upon receiving an input for changing the lighting state of luminaire 20 from a user via receiver 34 (e.g., a touch panel) of terminal device 30, controller 32 generates a control signal corresponding to the change and transmits the generated control signal to luminaire 20 via communication circuit 31.

Controller 32 is implemented as a processor that executes a control program stored on storage 33, but not limited to a processor. Controller 32 may be implemented as a microcomputer, a dedicated circuit, or the like.

It should be noted that, upon receiving response signal W2 from luminaire 20, controller 32 may display a message corresponding to response signal W2 on display 35. For example, if response signal W2 includes information indicating that luminaire 20 is turned off, controller 32 may display the message "luminaire is turned off", etc. on display 35.

Storage 33 is a storage device for storing a control program to be executed by controller 32. Storage 33 also stores the identification information of remote control 10 and the identification information of luminaire 20. For example, storage 33 is implemented as a flash memory, a semiconductor memory, or the like.

Receiver 34 is a user interface for receiving inputs (i.e., instructions) regarding the lighting state of luminaire 20 from a user, and is implemented as, for example, a touch panel (see FIG. 4). If receiver 34 is a touch panel, it is adhesively mounted on display 35 (e.g., a liquid crystal display). The user touches a specific portion of display 35 in which the desired lighting state among two or more lighting states (e.g., "turn on" or "turn off") is displayed, and thereby receiver 34 receives the instruction from the user. It should be noted that receiver 34 is not limited to the touch panel. For example, receiver 34 may be push buttons or a keyboard.

Display 35 is a display device, such as a liquid crystal display, for displaying information for controlling luminaire 20 or the receipt of the control signal from luminaire 20. It should be noted that the information for controlling luminaire 20 includes information on the current lighting state of luminaire 20.

Figure 2:
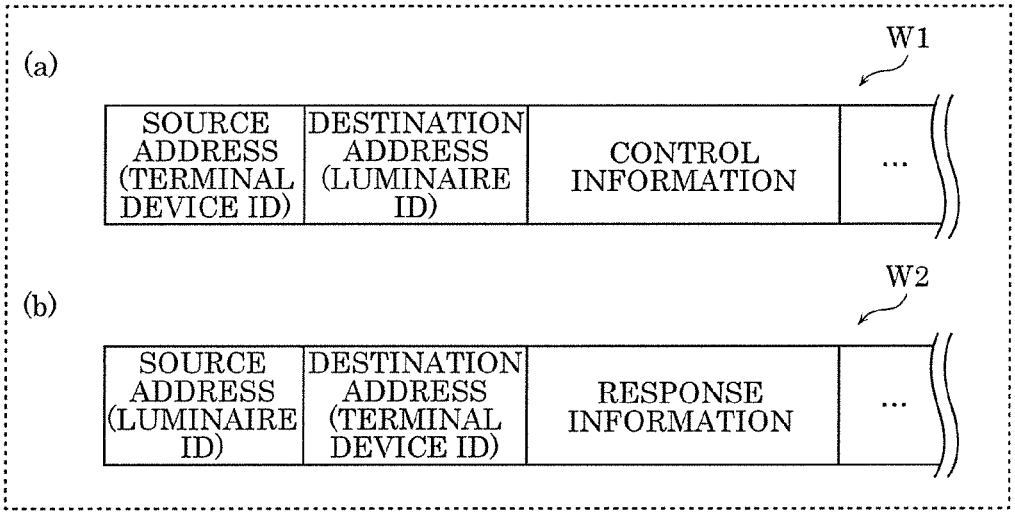
FIG. 2 is a schematic diagram illustrating data structures of a control signal and a response signal according to Embodiment 1.

Here, the data structures of control signal W1 and response signal W2 will be described with reference to FIG. 2. FIG. 2 is a schematic diagram illustrating the data structures of control signal W1 and response signal W2 according to the present embodiment. More specifically, the part (a) of FIG. 2 illustrates the data structure of control signal W1, and the part (b) of FIG. 2 illustrates the data structure of response signal W2.

As illustrated in the part (a) and the part (b) of FIG. 2, control signal W1 includes a source address, a destination address, and control information on luminaire 20, and response signal W2 includes a source address, a destination address, and response information.

As illustrated in the part (a) of FIG. 2, control signal W1 transmitted from remote control 10 to luminaire 20 includes the device ID of terminal device 30 as the source address, and the device ID of luminaire 20 as the destination address. Control signal W1 is characterized in that the device ID of terminal device 30 is included as the source address. Upon receiving control signal W1, controller 22 in luminaire 20 determines that control signal W1 is a signal transmitted from terminal device 30. Then, luminaire 20 causes communication circuit 21 to transmit response signal W2 shown in the part (b) of FIG. 2 to terminal device 30 determined as the source device. Moreover, the control information refers to information indicating an instruction from a user and is, for example, information indicating an instruction such as turning on or turning off.

As illustrated in the part (b) of FIG. 2, response signal W2 transmitted from luminaire 20 to terminal device 30 includes the device ID of luminaire 20 as the source address, and the device ID of terminal device 30 as the destination address. Moreover, the response information refers to information indicating that the lighting state is to be changed according to the control information, and is, for example, information indicating the state of luminaire 20 such as turned on or turned off.

Upon receiving response signal W2, terminal device 30 can obtain the current lighting state of luminaire 20 from the response information of luminaire 20 included in response signal W2.

[2. Operation of Lighting System]

Figure 3:
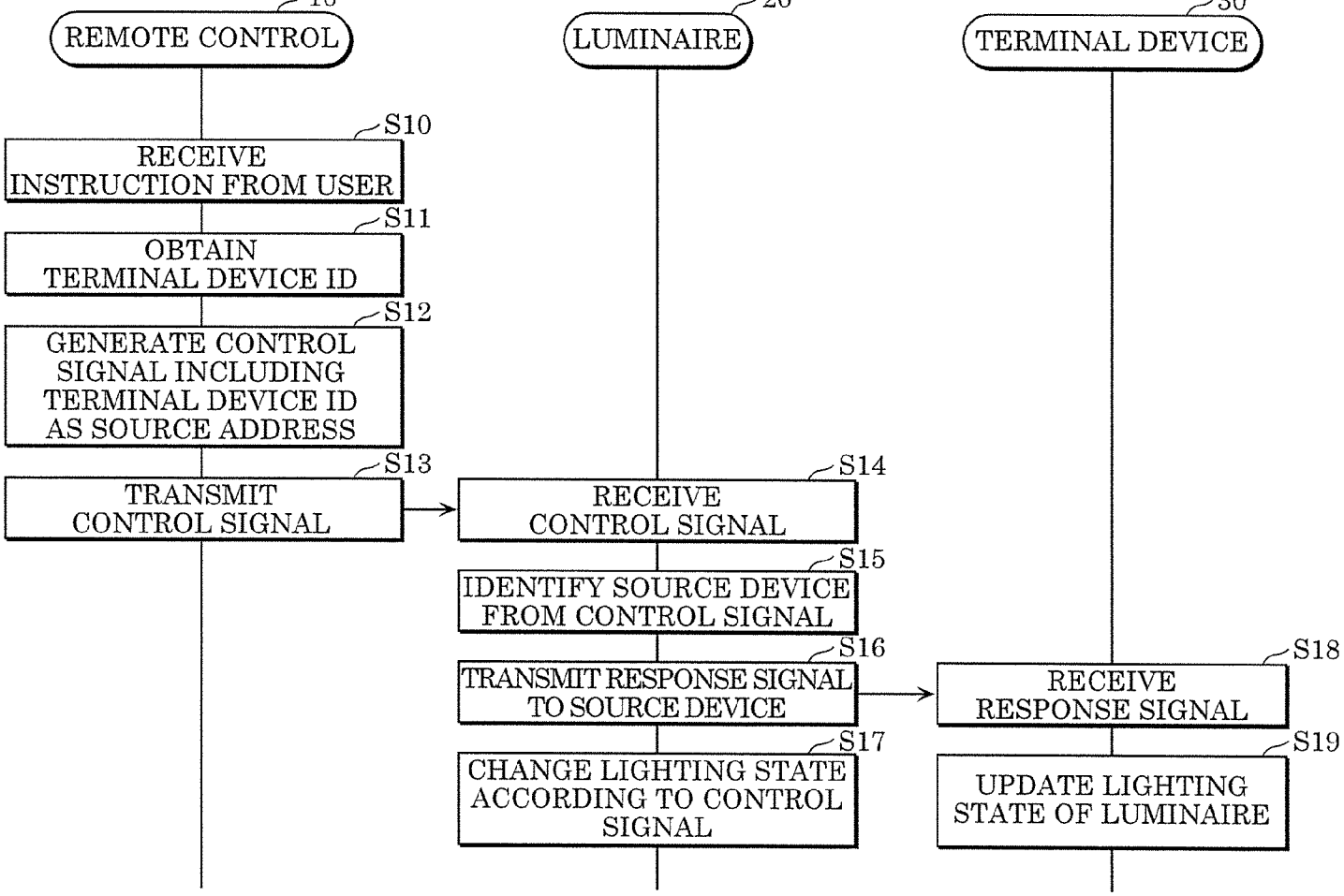
FIG. 3 is a sequence diagram illustrating the operation of a lighting system according to Embodiment 1.

Next, the operation of lighting system 1 will be described with reference to FIG. 3. FIG. 3 is a sequence diagram illustrating the operation of lighting system 1 according to the present embodiment. It should be noted that in the example of FIG. 3, a control signal is transmitted from remote control 10 (i.e., a user changes the lighting state of luminaire 20 using remote control 10). Moreover, remote control 10, luminaire 20, and terminal device 30 obtain each other's identification information when establishing the association between them (i.e., when setting up the connections), and the details will be described later. In other words, remote control 10 stores the identification information of luminaire 20 and terminal device 30, luminaire 20 stores the identification information of remote control 10 and terminal device 30, and terminal device 30 stores the identification information of remote control 10 and luminaire 20. Accordingly, remote control 10, luminaire 20, and terminal device 30 can wirelessly communicate with each other.

First, remote control 10 receives an input from a user (S10). More specifically, remote control 10 receives the input (i.e., an instruction) to luminaire 20 from the user via receiver 11. Upon receiving the input from the user, controller 12 obtains the identification information unique to terminal device 30 (e.g., the device ID) (S11). For example, controller 12 obtains the identification information of terminal device 30 by retrieving the identification information of terminal device 30 from storage 13. After obtaining the identification information of terminal device 30, controller 12 generates control signal W1 including the obtained identification information as the source address (S12). More specifically, control signal W1 for controlling luminaire 20 is generated based on the identification information of terminal device 30 and the input received from the user via receiver 11. For example, the data structure of control signal W1 generated at step S12 is shown in the part (a) of FIG. 2. Then, controller 12 transmits the generated control signal W1 to luminaire 20 via communication circuit 14 (S13). It should be noted that control signal W1 transmitted by remote control 10 is transmitted only to luminaire 20 and not transmitted to terminal device 30. It is possible to reduce the power consumption of remote control 10.

Control signal W1 is transmitted by remote control 10, and luminaire 20 receives control signal W1 via communication circuit 21 (S14). Controller 22 identifies the source device that has transmitted control signal W1, based on the received control signal W1 (S15). More specifically, controller 22 identifies the source device from the source address included in the received control signal W1. In the present embodiment, terminal device 30 is the source device. Then, controller 22 generates response signal W2 indicating the receipt of control signal W1. The source address in the received control signal W1 is used as the destination address in response signal W2. In other words, the destination of response signal W2 is terminal device 30. Moreover, the identification information of luminaire 20 is used as the source address in response signal W2. The response information included in response signal W2 indicates the lighting state of luminaire 20.

Controller 22 transmits the generated response signal W2 to terminal device 30 identified by the source address in control signal W1 (S16). Then, after transmitting response signal W2, controller 22 changes the lighting state of luminaire 20 based on the control information in control signal W1 (S17). More specifically, controller 22 changes the lighting state by adjusting electrical power (e.g., an amount of current) to light source 23 based on the received control information.

It should be noted that in the above example, upon receiving control signal W1, controller 22 transmits response signal W2 to terminal device 30 before controlling the lighting state of luminaire 20 based on the control information in control signal W1. It is possible to facilitate updating of the lighting state of luminaire 20 on terminal device 30.

Terminal device 30 receives response signal W2 transmitted from luminaire 20 via communication circuit 31 (S18). Then, controller 32 updates the lighting state of luminaire 20 stored on terminal device 30 based on the received response signal W2 (S19). It is possible to keep the lighting state of luminaire 20 stored on terminal device 30 updated even if terminal device 30 does not receive any signal from remote control 10.

It should be noted that in a conventional lighting system, when a remote control is used to control the lighting state of a luminaire, a terminal device is not notified that the lighting state of the luminaire has changed. Accordingly, when the terminal device is used to change the lighting state of the luminaire, a user is required to start with obtaining the current lighting state of the luminaire by operating the terminal device. This is a time-consuming operation. On the other hand, in lighting system 1 according to the present embodiment, the user can update the lighting state of luminaire 20 stored on terminal device 30 only by operating remote control 10.

Here, the association between remote control 10, luminaire 20, and terminal device 30 will be described with reference to FIG. 4. FIG. 4 is a schematic diagram illustrating the association of lighting system 1 according to the present embodiment. It should be noted that in the example of FIG. 4, luminaire 20 is a ceiling light mounted on ceiling 40.

First, the association between luminaire 20 and terminal device 30 will be described. The association between luminaire 20 and terminal device 30 refers to the establishment of encrypted communication between luminaire 20 and terminal device 30. More specifically, luminaire 20 and terminal device 30 exchange a common encryption key (e.g., a network key) with each other. In this manner, for example, when terminal device 30 transmits an encrypted control signal to luminaire 20, luminaire 20 can receive and decrypt the encrypted control signal. In other words, luminaire 20 and terminal device 30 can communicate with each other using encrypted communication. After establishing the encrypted communication, terminal device 30 and luminaire 20 obtain the identification information of luminaire 20 and the identification information of terminal device 30, respectively, by exchanging the identification information with each other.

It should be noted that the association between remote control 10 and terminal device 30 is established in the same manner. In other words, terminal device 30 is allowed to communicate with remote control 10 and luminaire 20 using the encrypted communication, and then obtains the identification information of remote control 10 and luminaire 20. It should be noted that remote control 10 obtains the identification information of luminaire 20 from terminal device 30, and luminaire 20 obtains the identification information of remote control 10 from terminal device 30. This allows remote control 10, luminaire 20, and terminal device 30 to communicate with each other using the encrypted communication and obtain each other's identification information. For example, remote control 10, luminaire 20, and terminal device 30 stores the obtained identification information on their respective storages.

[3. Effect]

Next, the effects of remote control 10 and lighting system 1 including remote control 10 according to the present embodiment will be described.

Remote control 10 is a remote control for controlling luminaire 20 that is wirelessly controllable with terminal device 30, and includes: receiver 11 that receives an input from a user; first communication circuit 14 that communicates wirelessly; and first controller 12 that generates control signal W1 and transmits control signal W1 to luminaire 20 via first communication circuit 14, in which control signal W1 corresponds to the input received by receiver 11 and includes identification information unique to terminal device 30 as a source address.

In this manner, luminaire 20 receives, from remote control 10, control signal W1 including the identification information of terminal device 30 as the source address. Then, luminaire 20 transmits a signal indicating the receipt of control signal W1 (e.g., response signal W2) to terminal device 30 identified by the source address in control signal W1 received from remote control 10. Terminal device 30 can update the lighting state of luminaire 20 stored on terminal device 30 by receiving response signal W2. In other words, a user can update the lighting state of luminaire 20 stored on terminal device 30 only by operating remote control 10. Accordingly, the user need not operate terminal device 30 to update the lighting state of luminaire 20, thereby improving the convenience of controlling luminaire 20 with terminal device 30.

Moreover, lighting system 1 according to the present embodiment includes remote control 10, luminaire 20 that is controlled by remote control 10, and terminal device 30 that wirelessly controls luminaire 20. Luminaire 20 includes communication circuit 21 that transmits, upon receiving control signal W1 from remote control 10, a signal indicating receipt of control signal W1 to terminal device 30 identified by the source address.

In this manner, luminaire 20 transmits a signal indicating the receipt of control signal W1 (e.g., response signal W2) to terminal device 30 identified by the source address in control signal W1 received from remote control 10. Terminal device 30 can update the lighting state of luminaire 20 stored on terminal device 30 by receiving response signal W2. In other words, a user can update the lighting state of luminaire 20 stored on terminal device 30 only by operating remote control 10. Accordingly, the user need not operate terminal device 30 to update the lighting state of luminaire 20, thereby improving the convenience of controlling luminaire 20 with terminal device 30.

Embodiment 2

Hereinafter, the lighting system according to Embodiment 2 will be described with reference to FIG. 5 and FIG. 6. In Embodiment 2, a switch installed in a part of a building is used to control luminaires installed inside a building.

First of all, lighting system 2 according to the present embodiment will be described with reference to FIG. 5. FIG. 5 is a block diagram illustrating an entire configuration of lighting system 2 according to the present embodiment.

Lighting system 2 according to the present embodiment includes luminaire 100, terminal device 200, and switch 300. Luminaire 100 and terminal device 200 have wireless communication functionality, and wirelessly communicate with each other. For example, luminaire 100 and terminal device 200 are devices between which the above-described association is established.

Figure 5:
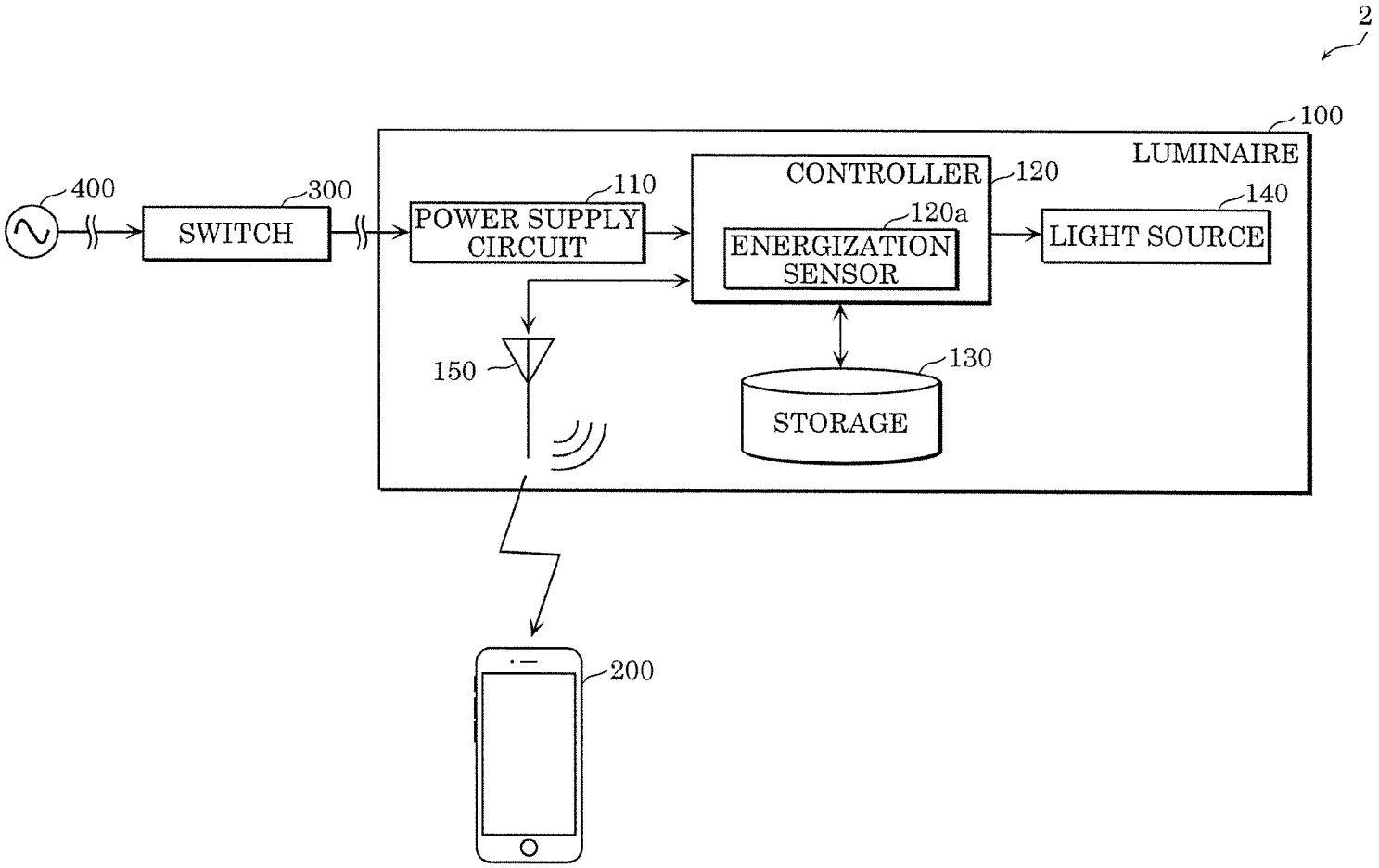
FIG. 5 is a block diagram illustrating an entire configuration of a lighting system according to Embodiment 2.
Figure 6:
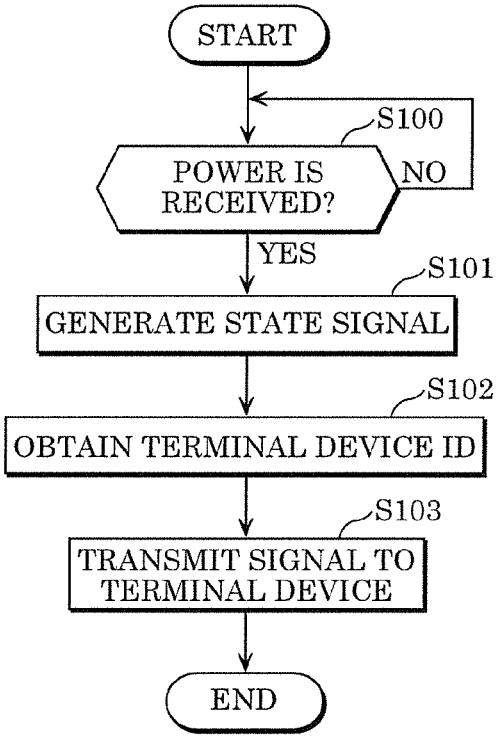
FIG. 6 is a flowchart illustrating the operation of a lighting system according to Embodiment 2.

It should be noted that in FIG. 5 there is a single luminaire, but the number of luminaires included in lighting system 2 is not limited to one. There may be two or more luminaires. Moreover, the wireless communication refers to, for example, a wireless communication using the Bluetooth (registered trademark) communication standard, but is not limited to this communication standard. Wireless LANs (e.g., Wi-Fi (registered trademark)) may be used.

Luminaire 100 is a lighting apparatus for indoor use which is installed inside a building and illuminates the indoor space. Luminaire 100 is powered and lighted by the electrical power to illuminate a space in which luminaire 100 is installed. Luminaire 100 is, for example, a ceiling light, a spot light, or a pendant light. It should be noted that luminaire 100 according to Embodiment 2 differs from luminaire 20 according to Embodiment 1 in that luminaire 100 includes energization sensor 120*a*. The descriptions of the same configuration as luminaire 20 are omitted or simplified.

As illustrated in FIG. 5, luminaire 100 includes power supply circuit 110, controller 120, storage 130, light source 140, and communication circuit 150. It should be noted that luminaire 100 is powered by commercial power supply 400 via switch 300. Switch 300 is a switch for turning on and off power from commercial power supply 400 to luminaire 100, and the details will be described later.

Power supply circuit 110 is a power converter for converting the alternating-current power from commercial power supply 400 into the direct-current power. For example, this power supply circuit consists of a filter, a full-wave bridge rectifier, and others.

Controller 120 is a control device for controlling each of the components by receiving the power from commercial power supply 400 via power supply circuit 110. For example, upon receiving the power from commercial power supply 400, controller 120 controls the lighting state of light source 140. Alternatively, upon receiving a control signal from terminal device 200 via communication circuit 150, controller 120 controls the lighting state of light source 140 based on the received control signal.

Controller 120 is implemented as a processor that executes a control program stored on storage 130, but not limited to a processor. Controller 120 may be implemented as a microcomputer, a dedicated circuit, or the like. It should be noted that if controller 120 supports dimming functionality, controller 120 includes a dimming control circuit (e.g., a pulse width modulation (PWM) circuit). In other words, an aspect of controller 120 is not particularly limited.

Moreover, controller 120 includes energization sensor 120*a* for sensing receipt of power from commercial power supply 400. For example, energization sensor 120*a* senses that luminaire 100 receives power from commercial power supply 400, by sensing that controller 120 is activated by power from commercial power supply 400. It should be noted that energization sensor 120*a* may be included in power supply circuit 110 and it is sufficient that the receipt of power from commercial power supply 400 can be sensed by turning on switch 300 and conducting from commercial power supply 400 to luminaire 100. It should be noted that controller 120 is an example of the second controller.

Storage 130 is a storage device for storing a control program to be executed by controller 120, identification information unique to terminal device 200, and more. For example, storage 130 is implemented as a flash memory, a semiconductor memory, or the like. It should be noted that when lighting system 2 includes a remote control for controlling luminaire 100, storage 130 also stores identification information unique to the remote control.

Light source 140 is the same configuration as light source 23 included in luminaire 20 according to Embodiment 1, and thus the descriptions thereof are omitted.

Communication circuit 150 is a wireless communication interface for luminaire 100 to wirelessly communicate with terminal device 200. Moreover, in the present embodiment, the wireless communications are performed using the Bluetooth (registered trademark) communication standard, and thus communication circuit 150 is a communication module (e.g., a communication circuit) supporting the Bluetooth (registered trademark) communication standard. Moreover, when energization sensor 120*a* senses the receipt of power, communication circuit 150 transmits a signal indicating the receipt of power (hereinafter referred to as a state signal) to terminal device 200. In other words, when energization sensor 120*a* senses receipt of power, controller 120 generates the state signal and transmits the generated state signal to terminal device 200 via communication circuit 150. It should be noted that when lighting system 2 includes a remote control for controlling luminaire 100, communication circuit 150 also receives a control signal from the remote control. It should be noted that communication circuit 150 is an example of the second communication circuit.

Terminal device 200 is a terminal that can wirelessly control luminaire 100 and is implemented as, for example, a smartphone, a mobile phone terminal, a tablet terminal, or a personal computer. It should be noted that terminal device 200 according to the present embodiment is a smartphone. Moreover, terminal device 200 receives the state signal transmitted from luminaire 100. Then, the lighting state of luminaire 100 stored on terminal device 200 is updated based on the received state signal. It should be noted that terminal device 200 may have the same configuration as terminal device 30 according to Embodiment 1.

Switch 300 is disposed between commercial power supply 400 and luminaire 100 and apart from luminaire 100, and is for turning on and off the power from commercial power supply 400 to luminaire 100, from outside luminaire 100. Switch 300 has one end electrically connected to commercial power supply 400 via a wiring and the other end electrically connected to luminaire 100 via a wiring, and electrically connects and disconnects commercial power supply 400 and luminaire 100. Switch 300 is fixed onto a part of a building, and is, for example, a wall switch disposed on an indoor wall.

Next, the operation of lighting system 2 will be described with reference to FIG. 6. FIG. 6 is a flowchart illustrating the operation of lighting system 2 according to the present embodiment.

First, luminaire 100 determines whether or not the power has been received (S100). More specifically, energization sensor 120*a* determines whether or not the power has been received based on whether controller 120 is activated or not. Upon receiving the power via switch 300 electrically connecting commercial power supply 400 and luminaire 100, controller 120 is activated to control each of the components. Energization sensor 120*a* senses the receipt of power, for example, by sensing the activation of controller 120.

When luminaire 100 receives the power (if Yes at S100), controller 120 generates a state signal to be transmitted to terminal device 200 (S101). Luminaire 100 is lighted by receiving the power. Accordingly, the state signal includes information indicating that luminaire 100 is lighted. It should be noted that when luminaire 100 does not receive the power (if No at S100), controller 120 waits until the power is received.

Next, controller 120 obtains, as the destination address in the state signal, the identification information of terminal device 200 stored on storage 130 (S102). Then, controller 120 transmits the state signal including the obtained identification information and information that luminaire 100 is lighted, to terminal device 200 via communication circuit 150 (S103).

Upon receiving the state signal from luminaire 100, terminal device 200 updates the lighting state of luminaire 100 stored on terminal device 200 using the information included in the received state signal and indicating that luminaire 100 is lighted. More specifically, terminal device 200 changes the lighting state to a new lighting state in which luminaire 100 is lighted. Terminal device 200 can keep the lighting state of luminaire 100 updated even when switch 300 is used to light luminaire 100.

In a conventional lighting system, when a luminaire receives power from a commercial power supply, a terminal device receives no information on the receipt of power from the luminaire. Accordingly, when the terminal device is used to control the luminaire, a user is required to obtain the current lighting state of the luminaire. This is a time-consuming operation. On the other hand, luminaire 100 according to the present embodiment includes energization sensor 120*a* to sense the receipt of power, thereby allowing terminal device 200 to receive information on the receipt of power. In other words, terminal device 200 can update the lighting state of luminaire 100 based on a signal transmitted from luminaire 100. In other words, a user can update the lighting state of luminaire 100 stored on terminal device 200, for example, only by operating a switch to start power supply to luminaire 100.

As described above, luminaire 100 included in lighting system 2 further includes energization sensor 120*a* that senses receipt of power from commercial power supply 400, and communication circuit 150 transmits a signal indicating the receipt of power (e.g., the state signal) to terminal device 200 when energization sensor 120*a* senses the receipt of power.

In this manner, when luminaire 100 receives power from commercial power supply 400, i.e., when luminaire 100 is lighted, luminaire 100 transmits a signal including information on the lighting state of luminaire 100 (e.g., the state signal) to terminal device 200. Then, terminal device 200 updates the lighting state of luminaire 100 stored on terminal device 200 based on the information on the lighting state of luminaire 100 included in the received signal. In other words, a user can update the lighting state of luminaire 100 stored on terminal device 200 only by operating switch 300 to start power supply to luminaire 100. Accordingly, the user need not operate terminal device 200 to update the lighting state of luminaire 100, thereby improving the convenience of controlling luminaire 100 with terminal device 200.

Luminaire 100 according to the present embodiment is wirelessly controllable with terminal device 200, and includes light source 140, energization sensor 120*a* that senses receipt of power from commercial power supply 400, and communication circuit 150 that transmits a signal indicating the receipt of power to terminal device 200 when energization sensor 120*a* senses the receipt of power.

With above mentioned configuration, luminaire 100 can transmit a signal including information on the lighting state of luminaire 100 (e.g., the state signal) to terminal device 200 when luminaire 100 receives power from commercial power supply 400 (i.e., when energization sensor 120*a* senses the receipt of power).

Variations

Although the present disclosure is described based on respective embodiments thus far, the present disclosure is not limited to the foregoing embodiments.

For example, the luminaire according to each of the foregoing embodiments controls the lighting state of the light source after transmitting the control information to the terminal device, but is not limited to this. For example, the transmission of the control information and the control of the lighting state of the light source may be performed in parallel.

Moreover, in the foregoing embodiments, the process performed by a specific processing unit may be performed by another processing. Moreover, the order of two or more processes may be changed, or two or more processes may be performed in parallel.

Although a remote control, a lighting system including the remote control, and a luminaire according to one or more aspects are described based on respective embodiments thus far, the present disclosure is not limited to the foregoing embodiments. In other instances, various modifications to the exemplary embodiment according to the present disclosure described above that may be conceived by a person skilled in the art and embodiments implemented in any combination of the components and functions shown in the exemplary embodiment are also included within the scope of the present disclosure, without departing from the spirit of the present disclosure.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A luminaire that is wirelessly controllable with a terminal device, the luminaire comprising:

a light source;

an energization sensor that senses receipt of power from a commercial power supply; and a communication circuit that transmits a signal indicating the receipt of power to the terminal device when the energization sensor senses the receipt of power which does not involve control from the terminal device, wherein the energization sensor is connected to a path for supplying power from the commercial power supply to the light source, the light source is not physically connected to the terminal device, and the energization sensor is internally provided in the luminaire.

2. The luminaire according to claim 1, further comprising:

a controller that controls a lighting state of the light source, wherein the energization sensor senses the receipt of power by sensing activation of the controller.

3. The luminaire according to claim 2, wherein the controller is implemented as a processor that controls the lighting state of the light source and causes the communication circuit to transmit the signal indicating the receipt of power to the terminal device.

4. The luminaire according to claim 1, wherein the light source is configured to be lighted by the power from the commercial power supply without involving the control from the terminal device.

5. The luminaire according to claim 1, wherein the signal indicating the receipt of power includes information indicating that the luminaire is lighted.

6. The luminaire according to claim 1, wherein the signal indicating the receipt of power includes a signal for updating a lighting state of the luminaire stored on the terminal device.

7. The luminaire according to claim 1, further comprising:

a controller that controls a lighting state of the light source; and a power supply circuit that converts an alternating-current power supplied from the commercial power supply into a direct-current power, and provides the direct-current power to the light source via the controller, wherein the energization sensor is connected to a path between the power supply circuit and the light source.

8. The luminaire according to claim 7, wherein the power supply circuit receives the alternating-current power via a switch for turning on and off, from outside the luminaire, power from the commercial power supply to the luminaire.

9. The luminaire according to claim 1, further comprising:

a controller that controls a lighting state of the light source; and a power supply circuit that converts an alternating-current power supplied from the commercial power supply into a direct-current power, and provides the direct-current power to the light source via the controller, wherein the energization sensor senses the receipt of power from the commercial power supply by sensing the direct-current power.

10. The luminaire according to claim 9, wherein the power supply circuit receives the alternating-current power via a switch for turning on and off, from outside the luminaire, power from the commercial power supply to the luminaire.

11. A lighting system comprising:

the luminaire according to claim 1;

the terminal device that wirelessly controls the luminaire; and a switch disposed between the commercial power supply and the luminaire and apart from the luminaire, the switch turning on and off power from the commercial power supply to the luminaire.

12. The lighting system according to claim 11, wherein the switch is installed in a part of a building.

13. The lighting system according to claim 11, wherein, upon receiving, from the luminaire, the signal indicating the receipt of power, the terminal device updates a lighting state of the luminaire based on the signal, the lighting state being stored on the terminal device.

14. The luminaire according to claim 1, wherein the energization sensor is undetachably connected to the path for supplying power from the commercial power supply to the light source.

15. The luminaire according to claim 1, wherein the communication circuit is installed on a ceiling.

16. The luminaire according to claim 1, wherein the luminaire is installed in a part of a building, and the energization sensor is not visually recognized in a state in which the luminaire is installed in the part of the building.

17. The luminaire according to claim 1, further comprising:

a power supply circuit that converts an alternating-current power into a direct-current power, the alternating-current power being supplied via a switch for turning on and off, from outside the luminaire, power from the commercial power supply to the luminaire.

18. The luminaire according to claim 17, further comprising:

a controller that controls a lighting state of the light source, wherein the power supply circuit provides the direct-current power to the light source via the controller.

19. The luminaire according to claim 1, wherein the luminaire is at least one of a spot light or a pendant light.

* * * * *